United States Patent [19]

Garbero et al.

[11] 4,162,814

[45] Jul. 31, 1979

[54] LIGHTED DISPLAY CHAMBER

[76] Inventors: James J. Garbero, 1114 McClaren Dr., Carmichael, Calif. 95608; Ronald F. Cook, 8 NW. Eighth St., Pendleton, Oreg. 97801

[21] Appl. No.: 924,913

[22] Filed: Jul. 17, 1978

[51] Int. Cl.[2] ..... A47B 77/00

[52] U.S. Cl. ..... 312/223; 312/196; 40/540; 362/280

[58] Field of Search ..... 312/223, 204, 196; 211/26; 40/540, 563; 362/197, 199, 203, 277, 280, 281

[56] References Cited

U.S. PATENT DOCUMENTS

| | | | |
|---|---|---|---|
| 838,075 | 12/1906 | Brown | 362/277 |
| 1,219,892 | 3/1917 | Witt | 211/26 |
| 1,235,484 | 7/1917 | Jones | 362/277 |
| 1,524,627 | 1/1925 | Meurer | 362/280 |
| 1,710,973 | 4/1929 | Echele et al. | 362/280 |
| 1,911,826 | 5/1933 | Kaelber | 211/26 |
| 1,969,306 | 8/1934 | Hunter | 312/223 |
| 2,178,634 | 11/1939 | Howenstine | 40/540 |
| 2,642,329 | 6/1953 | Fitzgerald et al. | 312/223 |
| 3,041,957 | 7/1962 | Liptay | 312/223 |

*Primary Examiner*—Victor N. Sakran
*Attorney, Agent, or Firm*—Mark C. Jacobs

[57] ABSTRACT

This application relates to a lighted display chamber for momentos, gimcracks, trophies and the like, and preferably translucent or transparent ones since the device of this invention includes a blinking light means to transmit light from the base through the display object. The blinking light is actuated by a predetermined positioning of the top of the display chamber.

15 Claims, 6 Drawing Figures

FIG. 5
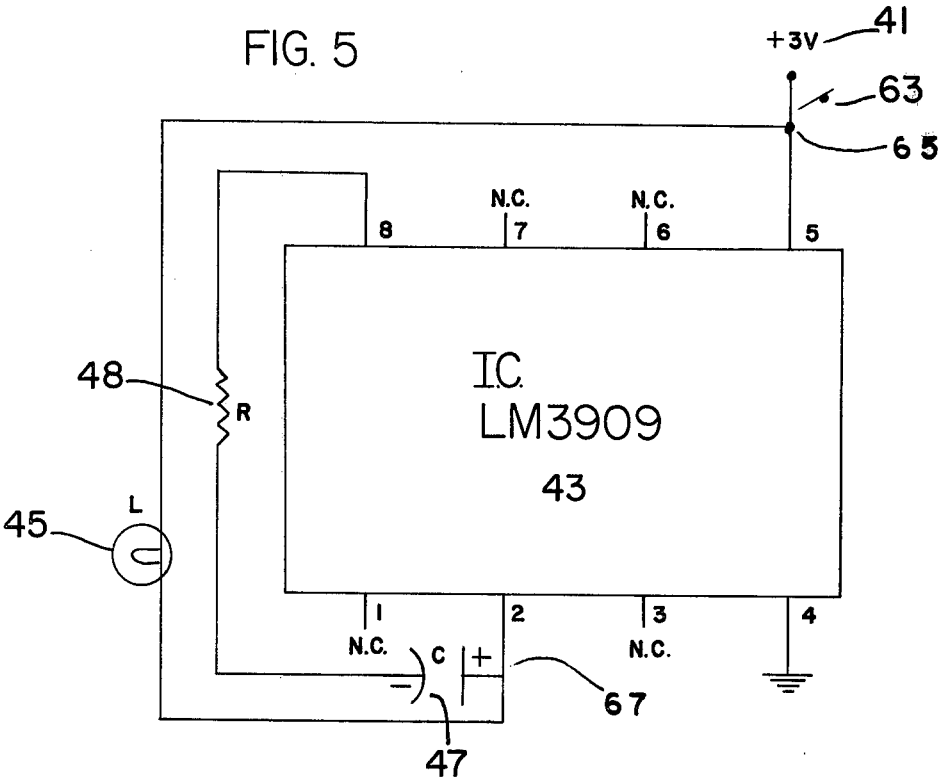
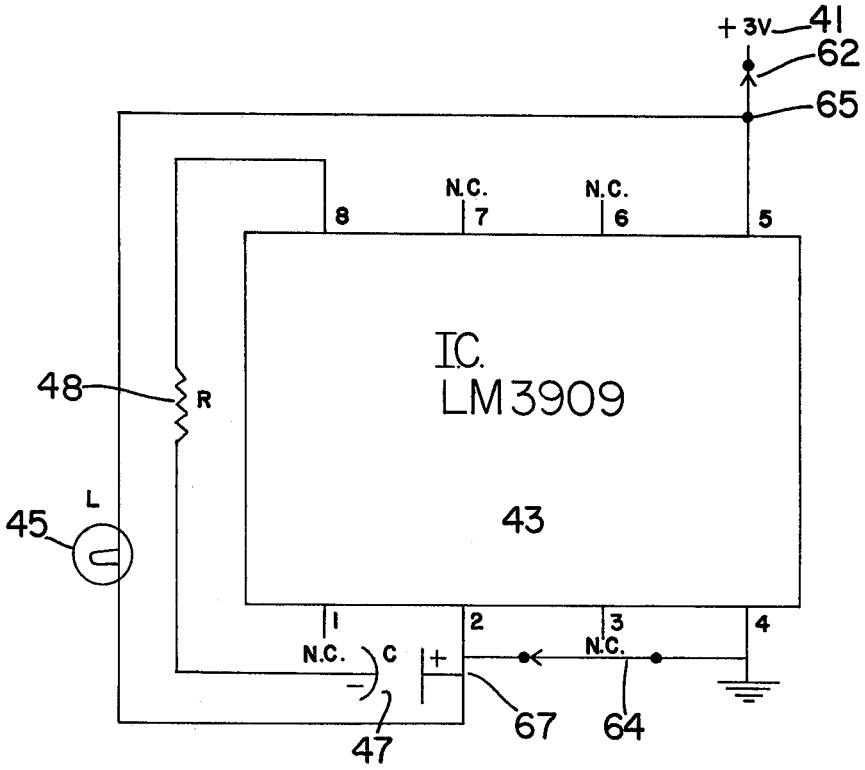
FIG. 6

LIGHTED DISPLAY CHAMBER

BACKGROUND OF THE INVENTION

Many people have a favorite keepsake that they desire to display, but are reluctant to do so because the item is small and easily lost, or because it is fragile and readily broken if mishandled. Mishandling can take place during periods of cleaning due to dust accummulation, or during display when the item is passed from hand to hand. Oftimes such items are translucent or transparent and made of materials such as milkglass, precious and semiprecious stones. In certain instances the keepsake may be made of plastic and still have value, such as an item from childhood, etc.

Frequently the owner or collector may have the desire to enhance the beauty of the object as by illuminating same, either continuously or intermittently. Intermittent lighting such as repetitive flashes will draw the viewer's attention to that particular item.

To the inventor's knowledge there has never been available previously a lighted display chamber for small articles of value that is both functional and decorative. Accordingly, it is one object of this invention to provide a lighted display chamber for small articles.

Another object is to provide an illuminated display chamber that features intermittent lighting.

Yet another object is to provide such a chamber or display case with light actuation means that does not detract from the beauty and line of the article.

Still another object is to provide a display chamber that will maintain the object being viewed relatively dust free.

These and other objects of this invention are in part set forth in the following specification, or will in part appear obvious therefrom.

The invention accordingly comprises the product possessing the features, properties and relation of components which are exemplified in the following detailed disclosure and the scope of the application of which will be indicated in the appended claims.

BRIEF DESCRIPTION OF THE DRAWINGS

FIG. 5 is a schematic diagram of the circuitry of the preferred embodiment.

FIG. 6 is a schematic diagram of the circuitry of an alternate embodiment of this invention.

DESCRIPTION OF THE PREFERRED EMBODIMENT

Figure 1:
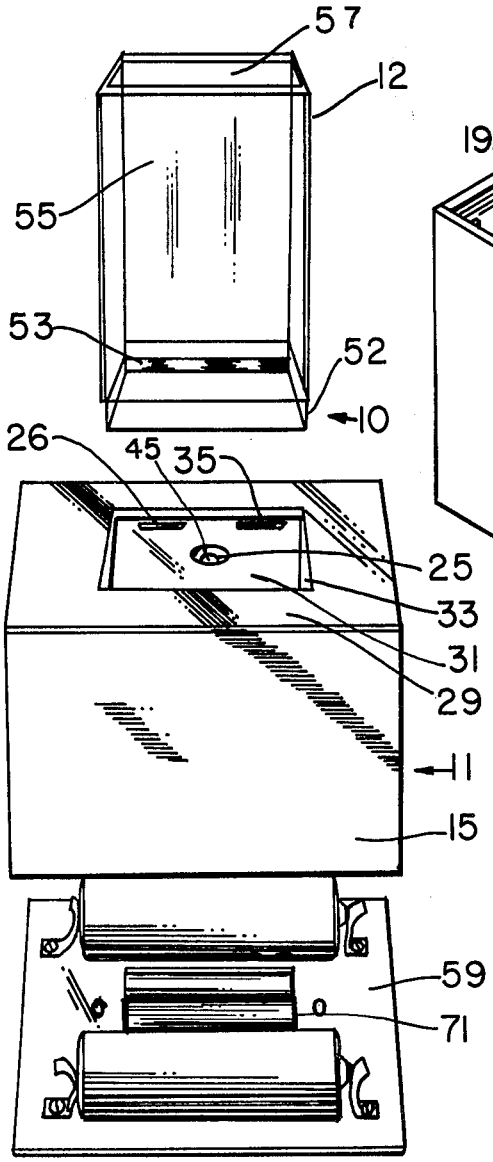
FIG. 1 is an exploded perspective view of a display chamber of this invention.

In FIG. 1 there is shown to be novel lighted display chamber 10 of this invention. Display chamber 10 is seen to constitute two section, a transparent top 12 and a preferably opaque bottom section 11. Section 12, the top, is seen to be a box-like structure having four connected upright circumscribing walls 55 and a top wall 57. Top 12 is open at the bottom. Each of said upright walls has a recessed rim 52, all of said rims being circumscribing and interconnected end to end. Secured to at least the outside edge of one of said rims 52 is copper contact strip 53. Preferably the strip should extend the entire length of said rims, be bent over along the edge and extend upwardly along the inside of said rim for also the entire length thereof. By so providing, electrical contact between 53 and the contact strip and wires 35 to operate switching means 63 can be ensured.

While shown in FIG. 1 to be basically square-shaped, top 12 may also be made in any other suitable configuration, such as rectangular, pentagonal, hexagonal or even circular. If circular, then contact strip 53 would merely be disposed upon a portion of rim 52. Contact strip 53 may be secured to rim 52 as by glueing with a suitable adhesive as determined by the skill of the art. Top 12 may be prepared from any material, something that is translucent or transparent such as Lucite® or Plexiglass®, acrylic sheet as well as stryene. If desired, top 12 may be premolded in one piece, in which contact strip 53 would be secured to one rim of the premolded article.

Figure 3:
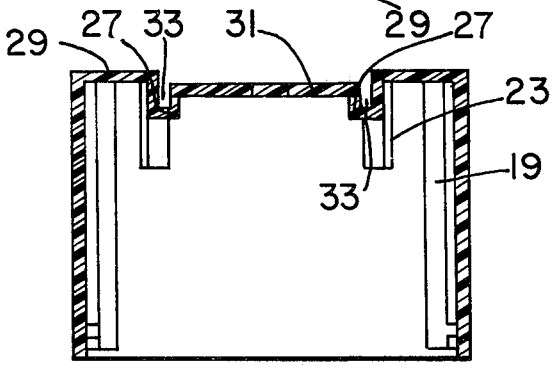
FIG. 3 is a cross-sectional view taken along the line A—A of FIG. 1.

Base 11 also constitutes a box-like structure. The base comprises a rigid frame closed on the sides, and ends by upstanding walls 15 and floor 29 disposed normal to said walls. Details on the construction of floor 29 as seen in FIG. 3 will be set forth below.

Figure 2:
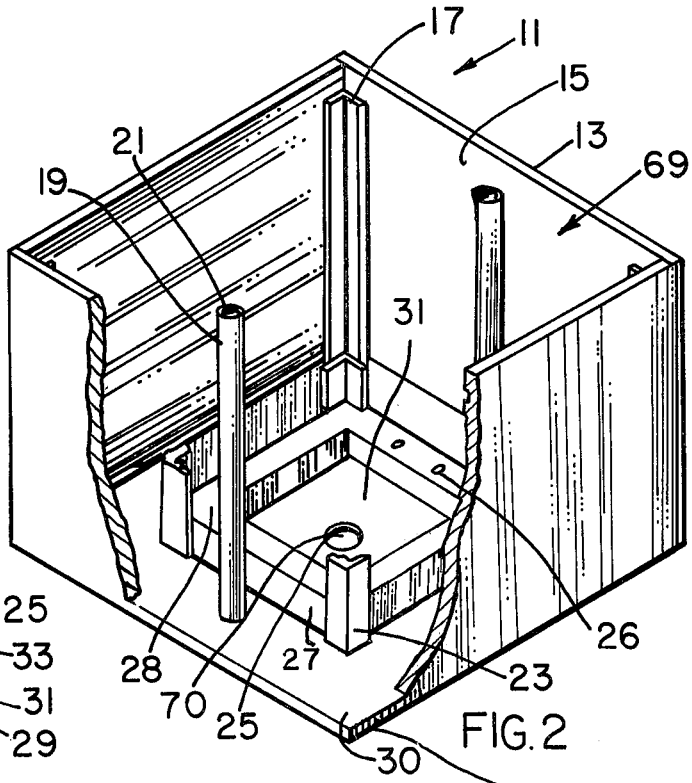
FIG. 2 is an inverted perspective view of the lower compartment thereof with two walls shown broken away.

From FIG. 2 it is seen that the frame of base 11 includes not only the walls 15 but interior L-corners 17 which constitute uprights secured in a spaced relationship to each other, and serve as reinforcements for the junction of the corner of each of the side walls, one to the other.

Bottom member 59 is sized in cross section slightly smaller than the interior cross section of the opening of the bottom of chamber 11. Bottom 59 is secured within the opening of bottom 11 by screws 61 not shown which secure bottom member 59 to risers 19, said risers 19 having threads 21 to receive said screws 61. See FIG. 2.

Risers 19 are disposed normal to the interior surface of floor 29 and are sized to be of the same elevation as L-corners 17. In this manner, floor 29 will rest on the edges of L-corners 17 and be recessed within the framework of the upstanding walls 15 to form a flush fit when inserted in place. Bore 25, positioned at the midpoint of floor 29, is positioned such that lamp 45, which itself is suitably mounted at the midpoint of circuit board 37, whereby when actuated light from said lamp will shine through said bore 25 into the top of the display case 12. While shown here as being at the midpoint of the circuit board afore, the lamp mounting sight and at the midpoint of floor 29 for bore 25, any aligned combination of the opening and the lamp may be employed such as to allow the light generated to communicate upwardly from the lower section of the chamber to the upper section.

Figure 4:
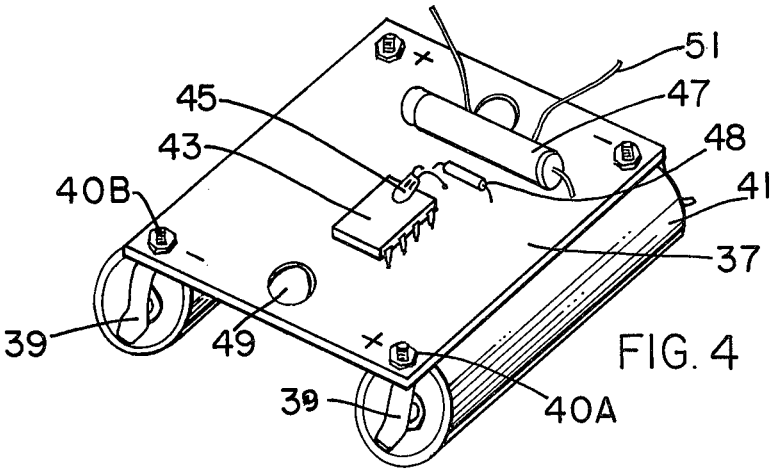
FIG. 4 is a top perspective view of the circuit board and electrical components employed in this invention's preferred embodiment.

With reference to FIG. 4, it is seen that circuit board 37 has a pair of bores 49 suitably located to be in alignment with risers 19 such that when said circuit board is inserted into the opening 69 of the bottom of the chamber 11, that circuit board 37 may disposed to abut upon the four stand-offs shown here to be of an L-shape configuration, 23. The stand-offs 23 are adhesed or otherwise secured to reinforcement members 27 which a J-shape interior framework 28 to reinforce the center of floor 29 and to hold depressed center 31 of floor 29. The cross section, FIG. 3, of depressed center 31 is sized such that upon it being adhered on its underside to the top of the short arm of the reinforcement members 27, a space corresponding to the width of slot 33, which is formed between the two arms of each of said J reinforcements 27, is maintained. It is also contemplated to have center 31 not depressed and in the same horizontal plane as the top of floor 29. One of said reinforcements 27 has two bores 26 therein which communicate through from the opening 69 to the slot 33. Portions 35 of 51 are disposed in slot 33 for electrical contact with contact strip 53 for actuation of the light as an on-off switch.

As is discussed in connection with the circuitry of the embodiment of FIG. 6, a second set of said slots 33 can also be provided with appropriate bores and contact wires for a dual mode light actuating means.

While discussed as separate components, it is obvious to the artisan that floor 29, center 31, reinforcements 27 and stand-offs 23 can also be formed at one time as a sub-assembly. Indeed though costly, perhaps risers 19 could be included therein as part of one large molded unit.

Turning to FIG. 4, there is shown the various components mounted upon the circuit board or secured thereto, which components form the circuitry to cause the light 45 to shine in a blinking fashion through opening 25 in the center 31 of the base of the chamber. There is shown a circuit board 37 having an integrated circuit chip 43, a lamp 45, resistor 48, electrolytic capacitor 47, and a pair of upstanding wires 51 mounted thereupon. Wires 51 are shown here to be of an inverted L-shape configuration, in that this is the position that said wires will alternately assume when said circuit board is assembled into the base of the device 10. The wires 51 are readily bendable, and when they are to be inserted into openings 26 they are bent upwardly, inserted through said bores, so that portion 35 protrudes through to the top side of slot 33. Thus 35 is bent normally downward to help retain the circuit board 37 in the desired relative relationship abutting stand offs 23.

In each corner of circuit board 37 and secured on the underside thereof, is a battery terminal 39, preferably brass, secured to circuit board 37 by suitable nuts and bolts **40*b* and 40*a*, such that each of said battery terminals 39 depends vertically relative to said circuit board. Disposed between each plus and minus terminal is a battery 41**.

Type C batteries are preferred over other 1½ volt batteries, such as D, because they take up less space. Penlite batteries, which are also 1½ volts, are not recommended because the life expectancy of said Penlite batteries is not adequate. As can be seen from FIG. 1, the batteries 41 are retained in place laterally by upstanding battery retainer plates 71.

Turning now to FIG. 5, there is to be described the electronic circuitry for operating and controlling the flashing light disposed within the base of the display chamber. It is seen that a pair of 1½ volt batteries, 41, preferably of the type C, are wired up in parallel, the positive terminal of one and the negative terminal of the other being separated by switch means 63. Switch means 63 is connected at one end to a junction 65 and on its opposite end to batteries 41. Junction 65 is connected to light 45 on one end and to pin 5 of integrated circuit LM3909, manufactured by National Semiconductor. Light for lamp 45 is a type 7203 (T-1) bulb, as typically manufactured by Chicago Miniature Lamp Works. The second terminal of lamp 45 is connected via a junction 67 to both the positive terminal of the electrolytic capacitor and to pin 2 of the I.C. This electrolytic capacitor is connected from its negative terminal through resistance 48, to pin 8 of the I.C. Resistor 48 will vary in ohmage from 100 to 1000 ohms depending on the desired amount of time that the flashing or blinking should transpire. The higher the resistance, the shorter the time that the light will be on. Pins 1, 3, 6, and 7 of the I.C. have no connection affixed thereto. Pin 4 of the I.C. is connected to ground. The value of electrolytic capacitor 47 will vary from 50 microfareds to 500 microfareds, depending upon the desired flash rate. Thus, but controlling the resistance and capacitance one can preselect the number of flashes per unit of time and the duration of such flashes. It is within the skill of the art to make such determinations as are suitable to the operator.

Switch means 63, rather than comprising a toggle switch, is seen to constitute wires 51 which operate to close the circuit when portions 35 are in intimate contact with copper contact strip 53, which contact strip is secured to rim 52 of the top 12 of the display chamber.

In FIG. 6 there is shown another embodiment of the invention wherein switch 63 is replaced by two separate single poll single throw SPST switches, 62 and 64. Pin 2 of IC 43 is connected through switch 64 which in turn is connected to ground. The connection of switch 63 is, as shown, connected to batteries 41 and pin 5 of chip 43. The use of such switches allows the light to flash intermittently, as in the first embodiment, or for the light to shine continuously by selection of the desired switch. Activation of the switching means would take place in the same manner as for the embodiment of FIG. 5 with the contact strip being rotated from one switch position to the other by removal of top 12 and rotation of same to a second position, 90° from the first actuation position.

Not discussed previously is part 70, best seen in FIG. 2. This is preferably a clear plastic insert to be adhered to the inside of bore 25. Such insert cover allows the light from the illumination source to pass therethrough, but prevents tiny display articles from falling through floor 29 into the bottom section, i.e. base 11.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A lighted display chamber for articles comprising a bottom section and a transparent top section, said top section being adapted to close a switch to switch on illumination source in said bottom section upon predetermined oriented contact of said top section with said bottom section, said top section including at least one upstanding side wall having an electrical contact at the bottom edge thereof, said bottom section being configured boxlike and comprising a floor having a bore therethrough for the transmission of light, and at least one upstanding side wall, secured normal to said floor and extending downwardly therefrom, thereby defining a space for the disposition of an illumination source, an illumination source disposed in said space and adapted to transact light through said floor's bore, means disposed in said bottom section adapted to cooperate with the electrical contact of said top section to switch on said illumination source when said top section is placed in contact with said bottom section in a predetermined orientation.

2. The display chamber of claim 1 wherein said illumination source includes means to cause the light emitted therefrom to flash on and off repetitively.

3. The display chamber of claim 1 including light flashing means and means adapted to cooperate with said top section's electrical contact to alternatively cause the light to shine continuously to flash repetitively upon the particular orientation of said top section upon contact thereof with said bottom section.

4. The display chamber of claim 2 wherein said bottom section and said top section are both square in horizontal cross section.

5. The display chamber of claim 4 wherein the top section is of a smaller cross section than the bottom section.

6. The display chamber of claim 1 wherein the illumination source is battery powered, and the batteries therefor are disposed in said bottom section.

7. The display chamber of claim 2 wherein the illumination source is battery powered, and the batteries therefor are disposed in said bottom section.

8. The display chamber of claim 3 wherein the illumination source is battery powered, and the batteries therefor are disposed in said bottom section.

9. The display chamber of claim 2 wherein the floor of said bottom section is opaque.

10. The display chamber of claim 3 wherein the floor of said bottom section is opaque.

11. The display chamber of claim 2 wherein the bore in the floor is centrally located.

12. The display chamber of claim 11 wherein the bore has a transparent cover secured to the top side of said floor thereover.

13. The display chamber of claim 3 wherein the bore in the floor is centrally located.

14. The display chamber of claim 13 wherein the bore has a transparent cover secured to the top side of said floor thereover.

15. In the display chamber of claim 1 wherein the means disposed in said bottom adapted to cooperate with the electrical contact of said top section comprises a pair of wires electrically connected to the illumination source that protrude upwardly through the floor of said bottom section.

* * * * *